United States Patent [19]

Heverly et al.

[11] Patent Number: 4,746,008

[45] Date of Patent: May 24, 1988

[54] CHILD-RESISTANT BOX FOR STORAGE OF HAZARDOUS MATERIALS

[76] Inventors: Karen H. Heverly; Larry R. Heverly, both of 894 Village Cir., Blue Bell, Pa. 19422

[21] Appl. No.: 68,444

[22] Filed: Jul. 1, 1987

[51] Int. Cl.[4] ..... H45C 13/10

[52] U.S. Cl. ..... 206/1.5; 220/306; 220/338

[58] Field of Search ..... 220/281, 306, 307, 338; 215/224; 206/1.5

[56] References Cited

U.S. PATENT DOCUMENTS

| | | | |
|---|---|---|---|
| 2,936,189 | 5/1960 | Pearson | 206/1.5 |
| 3,666,338 | 5/1972 | Russell | 206/1.5 |
| 3,907,103 | 9/1975 | Shaw | 206/1.5 |
| 4,109,785 | 8/1978 | Berghahn et al. | 206/1.5 |
| 4,401,210 | 8/1983 | Anjou | 206/1.5 |
| 4,511,032 | 4/1985 | Bush | 206/1.5 |
| 4,561,544 | 12/1985 | Reeve | 206/1.5 |

*Primary Examiner*—George T. Hall
*Attorney, Agent, or Firm*—David J. Johns

[57] ABSTRACT

The present invention discloses a child-resistant box for storage of medicine and other potentially harmful products. The invention comprises a lid hingedly connected to a receptacle and two sets of finger-actuated latches positioned around the circumference of the box, retaining the lid closed upon the receptacle. The latches are positioned so that only two adult hands can span the distance between the latches and actuate all the latches simultaneously so to open the box.

18 Claims, 2 Drawing Sheets

CHILD-RESISTANT BOX FOR STORAGE OF HAZARDOUS MATERIALS

BACKGROUND OF THE INVENTION

1. Field of the Invention

The present invention relates to child-resistant containers for storage of hazardous material. More specifically, the present invention provides a child-resistant box with multiple finger-actuated latches for storage of medicine and other potentially harmful substances.

2. Description of the Prior Art

Storage of necessary household products which can seriously injure children who may ingest or otherwise improperly use them has long been a major concern for parents. Although locked storage in out-of-the-way places works for many such products, medicines and similar products usually must be kept readily available while remaining inaccessible to children.

One common response is to employ "child-proof" caps on the medicine containers which only can be opened with the cap set in a certain direction or with a particular pressure applied to the cap. One such device is disclosed in U.S. Pat. No. 4,170,315 issued to Dubach et al. Although such devices are commonly employed today, their use is not uniform and they suffer from other considerable problems, including: many adults, particularly infirm persons, have difficulty operating such caps; many children, despite their small size, have little difficulty operating them; and their effectiveness can be fully compromised if the caps are not properly applied—without always being visually apparent.

One solution to these problems is to store the products in a locked box which only an adult can open. Although a key lock may be most effective to this end, it is also cumbersome, expensive, prone to lost keys, and again may be compromised if the child has access to the keys. Other boxes have been proposed to avoid these problems. Two examples of such devices are disclosed in U.S. Pat. Nos. 2,939,189 issued to Pearson and 3,907,103 issued to Shaw.

The Shaw patent discloses a locked box with a hinged lid held in place by hidden latches. The box is opened by squeezing the distortable side walls in a certain sequence to release the latches. The Pearson patent discloses a box with a hinged lid having two sets of spring-urged, finger-actuated latches on its top surface spaced apart at the span of an adult's hand. It is opened by using two hands to actuate the two sets of latches. Although both these devices may provide adequate security while remaining accessible to most adults, they are not without their own problems.

The Shaw device may prove difficult to open by some adults in that a substantial pressure must be applied to distort its walls prior to opening. It does not protect against certain children who seem particularly adept at opening pressure-actuated containers, such as child-resistant caps, through simple trial and error. Additionally, the completely concealed latches and method of opening may prove too challenging for many adults. The Pearson device is much more readily opened, and it is not easily defeated through mere pressure experimentation. However, it is a needlessly complex device. Moreover, the presence of all four latches on a single surface presents a child with a complete view of all the elements which must be actuated to open the box—making opening using straightedges, a counter top, or through a concerted effort with another child each a dangerous possibility.

In light of the foregoing, it is a primary object of the present invention to provide a child-resistant box which is easily opened by an adult but is intricate enough that it cannot be defeated through trial and error, and is difficult to defeat using simple tools or assistance of another child.

It is a further object of the present invention to provide a child-resistant box which is durable yet simple and inexpensive to construct.

SUMMARY OF THE INVENTION

The present invention provides a child-resistant box for storage of medicine and similar products which is readily opened by an adult but is inaccessible to a child.

The child-resistant box of the present invention comprises a lid hingedly connected to a receptacle and multiple finger-actuated latch means to retain the lid closed upon the receptacle. The latches are placed around the circumference of the box so that all the latches which must be actuated to open the box cannot be readily seen at one time. The latches are positioned so that only two adult hands can span the distance between them and actuate them all simultaneously to open the box.

The present invention may be easily manufactured and lends itself to relatively inexpensive injection molding manufacturing process. The box produced is strong and particularly effective at securing medicines from access by children. The design is far less prone to failure or defeat by precocious children than are presently known devices.

DETAILED DESCRIPTION OF THE INVENTION

The present invention provides a unique child-resistant box 10 for storage of medicines and other potentially harmful products, which is easily opened by an adult but cannot be opened by a child with small hands.

Figure 1:
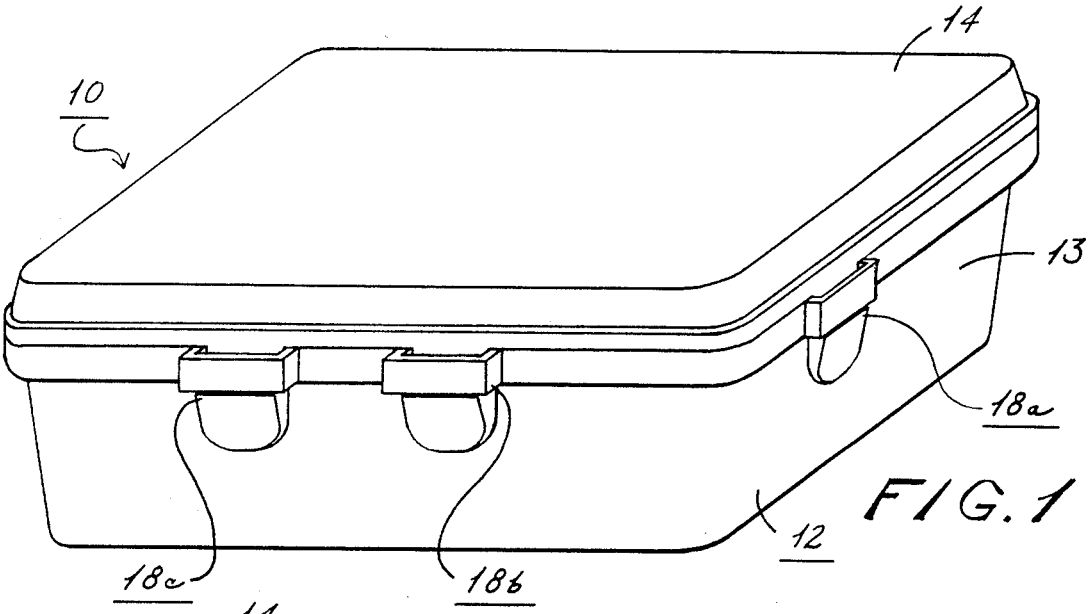
FIG. 1 is an elevated three-quarter view of the present invention with its lid closed and locked.
Figure 2:
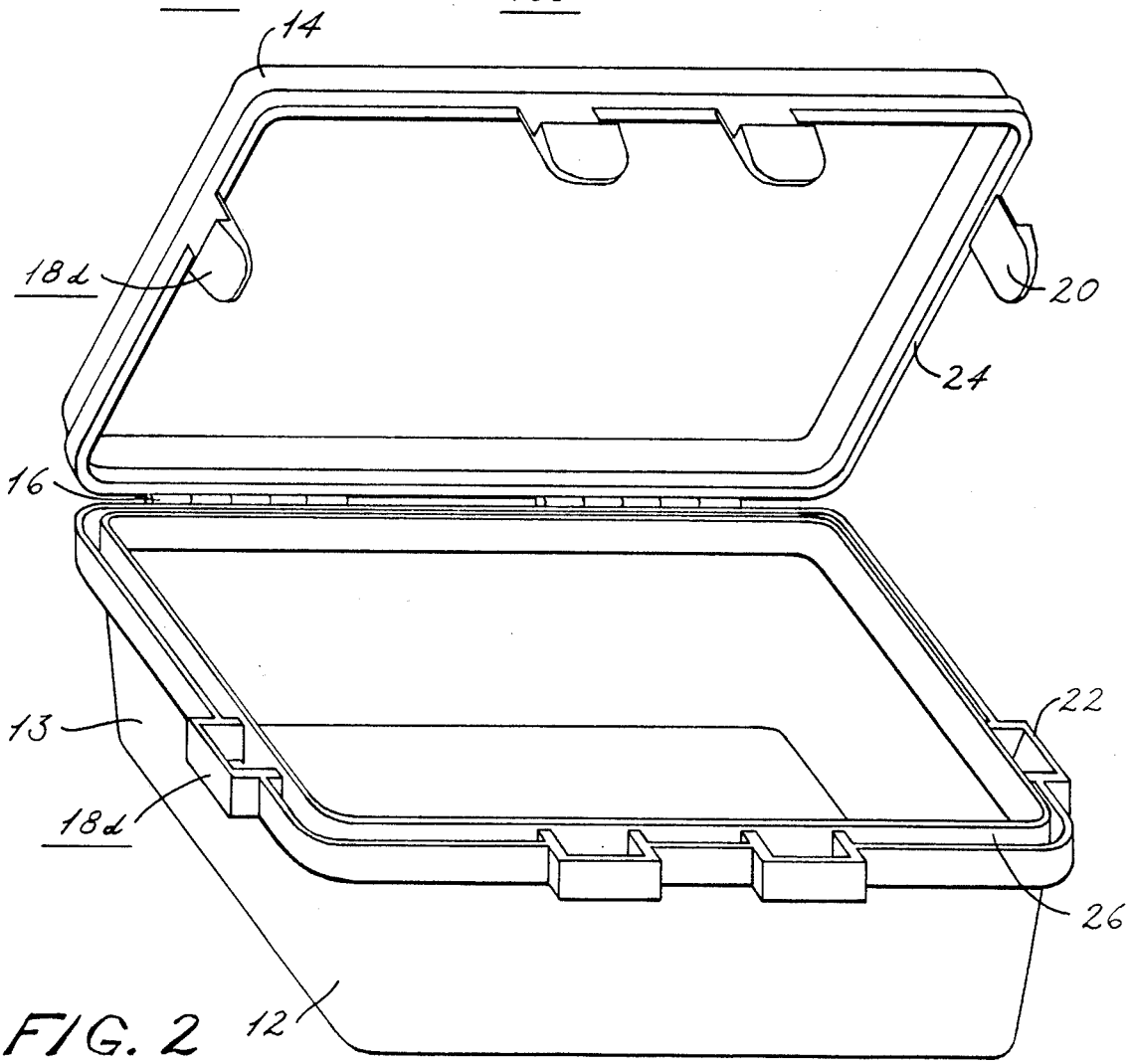
FIG. 2 is an elevated three-quarter view of the present invention with its lid open.

As is shown in FIGS. 1 and 2, the box 10 comprises a receptacle 12 with multiple side walls 13, and a lid 14. The lid 14 is attached to the receptacle 12 by two sets of hinges 16. The box may be of any convenient shape, including rectangular, triangular, round or oval. As will become apparent from the discussion set forth below, the preferred shape for both security and storage means is rectangular.

When the lid 14 is closed, as is shown in FIG. 1, the lid 14 is retained against the receptacle 12 by four finger-actuated latches 18. Each latch 18 comprises a locking means 20 attached to either the lid 14 or the receptacle 12 and a corresponding retaining means 22 attached to the complementary portion of the box 10. The latches 18 are spaced around the circumference of the lid 14. The latches 18 are arranged in two sets: a right set comprising latches 18*a* and 18*b;* and a left set comprising latches 18*c* and 18*d*. The placement of the latches 18 is crucial to the operation of the present invention.

The principle employed by the present invention is that the latches must be oriented so that two hands are necessary to open the box 10 and that a child's hand cannot span the distance between the two latches 18 of either set. It has been found that the linear distance around the circumference of the box 10 between the two latches 18 of each set should be 4.5" to 6.0". The preferred distance should be 5.0" to 5.25".

Although this general principle of latch orientation is not unknown, in past attempts to employ this basic principle, as disclosed in U.S. Pat. No. 2,936,189 issued to Pearson, a major drawback has been that the latches have been presented so that all the latches necessary to operate the invention may be seen at once. This neglects one of the most important security means for any child-resistant container—concealing the manner of unlocking the container.

The present invention contemplates placing the latches 18 so that all four are not readily visible from any particular orientation. Accordingly, the latches 18 of each set are placed on different sidewalls 13 of the box 10, each latch 18 of a set separated by a bend in the sidewall 13. For most purposes, a rectangular box 10 has proven most effective both in separating the latches 18 and in overall utility.

As is shown in FIG. 2, the preferred latch 18 comprises a locking means 20 shaped as a wedge-shaped tongue 20 and a retaining means 22 shaped as an inclined groove 22. A particular advantage of such latches 18 is that they can be quickly and inexpensively molded directly into the lid 14 and receptacle 12 during the manufacturing process. The preferred box 10 is constructed by injection molding acrylonitrile-butadiene-styrene copolymer (known as "ABS") plastic into a mold at an average thickness of 0.06 inch. The mold can be readily made to include the necessary tongues 20 and grooves 22. This process greatly reduces the assembly time required to construct the present invention and creates a box 10 which is exceptionally strong and durable.

The security and durability of the box 10 may be further enhanced by molding a downward-facing flange 24 into the perimeter of the lid 14 and a corresponding slot 26 into the sidewall 13 to receive the flange 24. This increases the strength of the box 10 and eliminates a child's ability to pry the box 10 open. FIG. 2 demonstrates how the tongues 20 and grooves 22 may be readily adapted to retain the flange 24 firmly in the slot 26 without altering the desired one-step injection molding manufacturing process.

Figure 3:
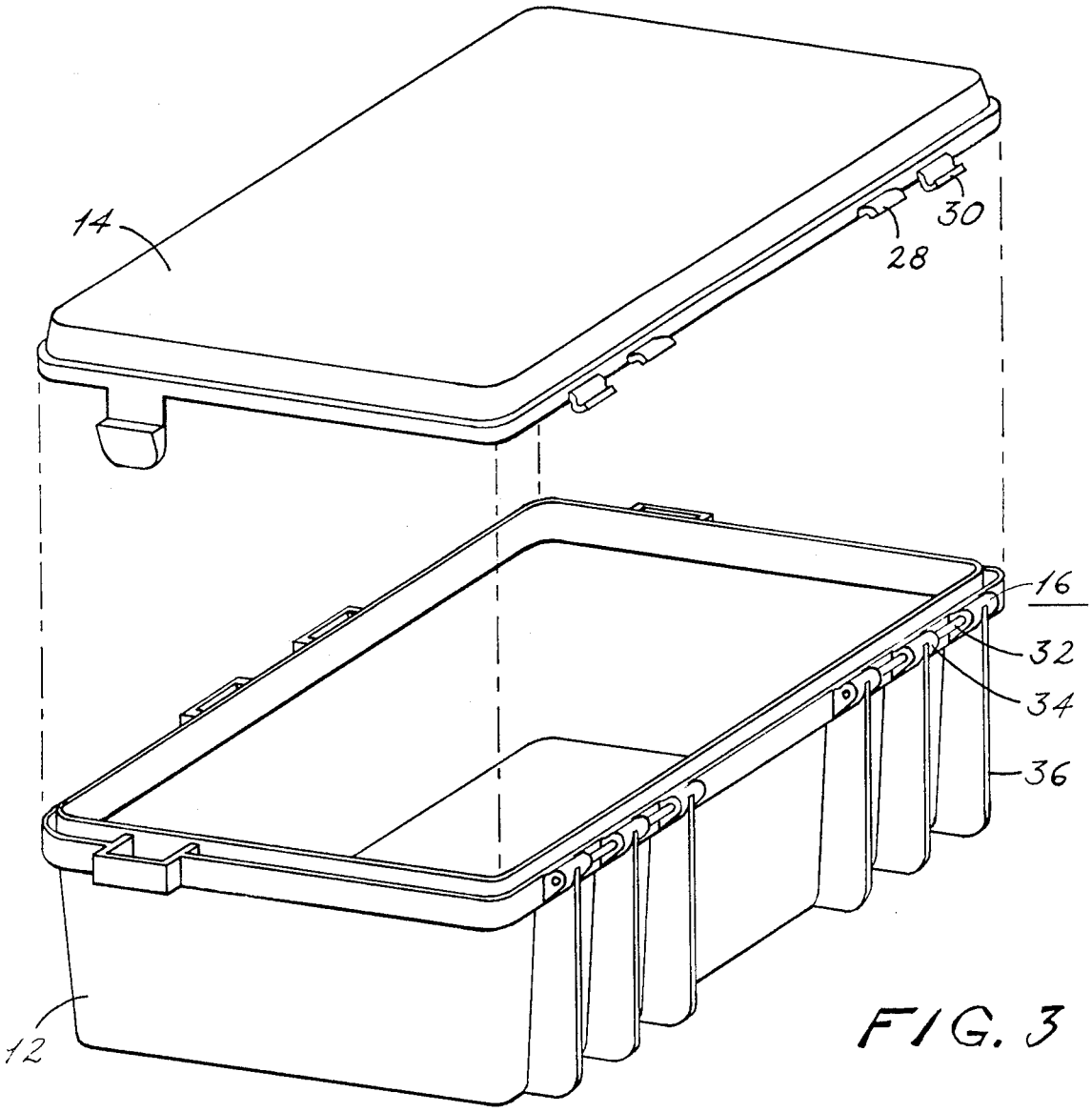
FIG. 3 is an elevated three-quarter view of the opposite side of the present invention with its lid shown in exploded orientation.

The hinged connection between the lid 14 and the receptacle 12 is shown in FIG. 3. The hinge 16 may comprise a downward-facing projection 28 and an upward-facing projection 30, each molded into the lid 14, and a hinge pin 32 retained between two or more protuberances 34 molded into the backside of the receptacle 12. The projections 28, 30 are adapted to surround the hinge pin 32 and permit the lid 14 to rotate around the axis of the hinge pin. The projections 28, 30 should be oriented so that they may be "snapped" into position around the hinge pin 32 when the lid 14 is positioned perpendicular to the receptacle.

A simpler hinge 16, not shown, is possible by molding the lid 14 and the receptacle 12 from ABS plastic material and having a web of the material form a flexible connection between the two. Although not necessary, the web may be reinforced by molding fiberglass filler within the material. This form of hinge may further reduce the manufacturing costs while providing an adequate hinge.

The protuberances 34 may be further reinforced by the addition of fins 36 attached to both the receptacle 12 and the protuberances 34. The fins 36 can be created through a minor modification of the injection molds. The fins 36 may be designed to provide an important further advantage of a surface to retain the box 10 in a perpendicular position for storage. This is particularly beneficial for storage in conventional medicine cabinets.

While particular embodiments of the present invention have been disclosed herein, it is not intended to limit the invention to such disclosure, and changes and modifications may be incorporated and embodied within the scope of the following claims.

What is claimed is:

1. In a child-resistant box containing a lid, a receptacle portion with a bottom and a sidewall, said sidewall containing at least one bend, and multiple sets of latches releasably retaining said lid to said receptacle, said latches of each set spaced a distance apart greater than the span of a child's hand, the improvement which comprises attaching the lid to the receptacle using a hinge means;

positioning the latches around the receptacle so that an adult's hand must reach around a bend of the sidewall to actuate each set of latches;

wherein each latch comprises a locking means and a retaining means, and said locking means and said retaining means being integral with the box.

2. An apparatus in accordance with claim 1 wherein said locking means comprises a tongue latch and said retaining means comprises a corresponding groove.

3. An apparatus in accordance with claim 2 wherein each latch is constructed from the same material as a portion of the box to which it is attached.

4. An apparatus in accordance with claim 3 wherein said box is constructed from a plastic.

5. An apparatus in accordance with claim 4 wherein said plastic is injection molded ABS plastic.

6. An apparatus in accordance with claim 1 wherein said hinged means are contoured flanges abutting a separate hinge pin.

7. An apparatus in accordance with claim 1 wherein said hinged means is flexible material affixed between the lid and the receptacle.

8. An apparatus in accordance with claim 7 wherein said flexible material is the same material as the box.

9. Apparatus in accordance with claim 8 wherein said flexible material is ABS plastic.

10. Apparatus in accordance with claim 1 wherein said hinge means is reinforced with a plurality of fins attached to the box.

11. Apparatus in accordance with claim 10 wherein said hinge means comprise contoured projections attached to said box abutting a separate hinge pin attached to said box.

12. Apparatus in accordance with claim 11 wherein support for said hinge pin includes said fins.

13. Apparatus in accordance with claim 12 wherein said fins are constructed of the same material as a portion of the box to which they are attached.

14. Apparatus in accordance with claim 10 wherein said fins provide a stand for the box.

15. In a box resistant to opening by a child containing a lid, a receptacle portion with a bottom and a sidewall, said sidewall containing at least one bend, and multiple sets of hand-actuated latches releasably retaining said lid to said receptacle, said latches of each set spaced a distance apart greater than the span of a child's hand, the improvement which comprises attaching the lid to the receptacle using a hinge means, said hinge means being reinforced with a plurality of fins;

positioning the latches around the sidewall of the receptacle so that an adult's hand must reach around a bend of the sidewall to actuate each set of latches; and wherein each latch comprises a locking means and a retaining means, and said locking means and said retaining means being integral with the box.

16. An apparatus of claim 15 wherein said fins provide a stand for the box.

17. An apparatus of claim 15 wherein said hinge means comprise contoured flanges attached to said box abutting a separate hinge pin attached to said box.

18. An apparatus of claim 17 wherein support for said hinge pin includes said fins.

* * * * *